US008678829B2

(12) United States Patent
Manfre

(10) Patent No.: US 8,678,829 B2
(45) Date of Patent: Mar. 25, 2014

(54) THERAPY DEVICE

(76) Inventor: Daniel George Manfre, Plant City, FL (US)

( * ) Notice: Subject to any disclaimer, the term of this patent is extended or adjusted under 35 U.S.C. 154(b) by 333 days.

(21) Appl. No.: 13/274,430

(22) Filed: Oct. 17, 2011

(65) Prior Publication Data

US 2013/0095983 A1 Apr. 18, 2013

(51) Int. Cl.
*G09B 19/00* (2006.01)

(52) U.S. Cl.
USPC ..... 434/258

(58) Field of Classification Search
USPC ..... 434/236, 247, 258, 260; 482/138, 910; 601/23, 24, 33
See application file for complete search history.

(56) References Cited

U.S. PATENT DOCUMENTS 3,592,472 A * 7/1971 Kent ..... 273/241
4,485,585 A * 12/1984 Shackelford et al. ..... 446/117
4,541,806 A * 9/1985 Zimmerman et al. ..... 434/258
4,692,119 A * 9/1987 Ussery ..... 434/259
5,092,591 A * 3/1992 Tol ..... 482/114
5,490,517 A * 2/1996 Whitman et al. ..... 600/587
5,839,991 A * 11/1998 Hall ..... 482/23
6,142,786 A * 11/2000 Culberson et al. ..... 434/258
2006/0134589 A1* 6/2006 Goodwin ..... 434/259

OTHER PUBLICATIONS

Saebo Multi-Purpose Exercise Device located in the rehab supply section of the Patterson Medical website on Oct. 15, 2011; http://pattersonmedical.com/app.aspx?cmd=get_product&id=60131.
Plastic Stacking Cones located in the rehab supply section of the Patterson Medical website on Oct. 15, 2011; http://pattersonmedical.com/app.aspx?cmd=get_product&id=49467.

* cited by examiner

*Primary Examiner* — Kurt Fernstrom
(74) *Attorney, Agent, or Firm* — Lonnie R Drayer

(57) ABSTRACT

A device for physical and/or occupational therapy has a pair of spaced apart vertical structural members joined to one another by a pair of spaced apart horizontal structural members. Each of the vertical and horizontal structural members has at least one target protruding from the structural member. A tool has an interior passage of a size that can receive a target whereby a physical therapy patient can grasp the tool and place the tool on a target designated by a therapist such that the target is located in the interior passage of the tool.

20 Claims, 11 Drawing Sheets

THERAPY DEVICE

FIELD OF THE INVENTION

The present invention relates to a device having utility for physical and/or occupational therapy of a patient.

BACKGROUND OF THE INVENTION

Physical therapy, sometimes called physiotherapy, may be generally defined as the treatment or management of physical injury, disability malfunction or pain by the use of special physical exercises and the application of modalities, such as massage and hydrotherapy, intended to improve, restore or facilitate normal function or development. A health professional that provides such care is called a physical therapist. Occupational therapy may be generally defined as therapy based on engagement in meaningful activities of daily life, especially to enable or encourage participation in such activities in spite of impairments or limitations in physical or mental function. A health professional that provides such care is called an occupational therapist.

Physical and occupational therapists have a great variety of devices at their disposal for use in providing therapy to patients. Such devices range from simple balls that may be squeezed by a patient to complex exercise equipment provided with pulleys, levers, gears, cables and other complex machinery. A drawback of most therapy devices, be they simple or complex, is that they are limited to use for only one or few exercises. This causes a therapy facility, and some independent therapists, to obtain and maintain an inordinate number of therapy devices, some of which may be used only sporadically. An important aspect of physical and occupational therapy that is not addressed by many prior art therapy devices is the importance of providing objective means for measuring the status and improvement of a patient during the course of therapy. This type of information is important for reporting on a physical or occupational therapy patient to his or her physician and medical insurance carrier.

A therapy device according to the present invention has utility in both physical and occupational therapy. The therapy device of the present invention may be used by a patient for a variety of exercises, and the device includes features to facilitate objective measurement of the status and improvement of a patient during the course of therapy.

SUMMARY OF THE INVENTION

There is provided in accordance with one aspect of the present invention a therapy device having a pair of spaced apart vertical structural members joined to one another by a pair of spaced apart horizontal structural members. Each of the vertical and horizontal structural members has at least one target protruding from the structural member. A tool has an interior passage of a size that can receive a target whereby a physical therapy patient can grasp the tool and place the tool on a target designated by a therapist such that the target is located in the interior passage of the tool.

In accordance with another aspect of the invention each of the vertical structural members of the therapy device is provided with at least one horizontally extending target, the horizontally extending targets on each of the vertical structural members are located at the same height and the horizontally extending targets are parallel to one another. The therapy device includes a bar and a means for fixing the bar in place either against the horizontally extending targets of the two vertical structural members with the bar oriented horizontally, or against the horizontally extending targets of only one of the vertical structural members with the bar oriented vertically. A therapy patient can pinch and attach at least one spring loaded clothespin to the bar.

In accordance with yet another aspect of the invention the therapy device includes fine motor skill targets and fine motor skill tools. A therapy patient can employ fine motor skills for mating the fine motor skill tools to the fine motor skill targets.

DETAILED DESCRIPTION OF THE INVENTION

Figure 1:
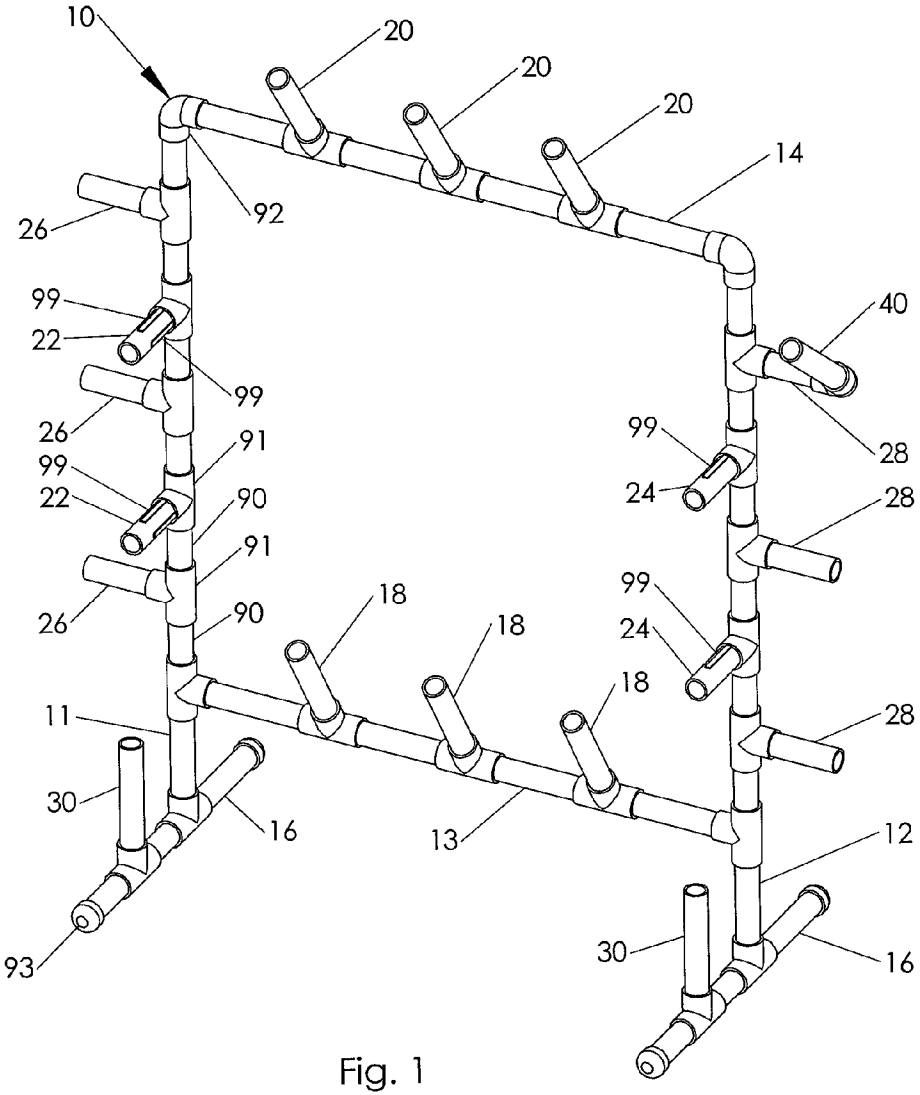
FIG. 1 is a perspective view of a first exemplary embodiment of a therapy device of the present invention.
Figure 2:
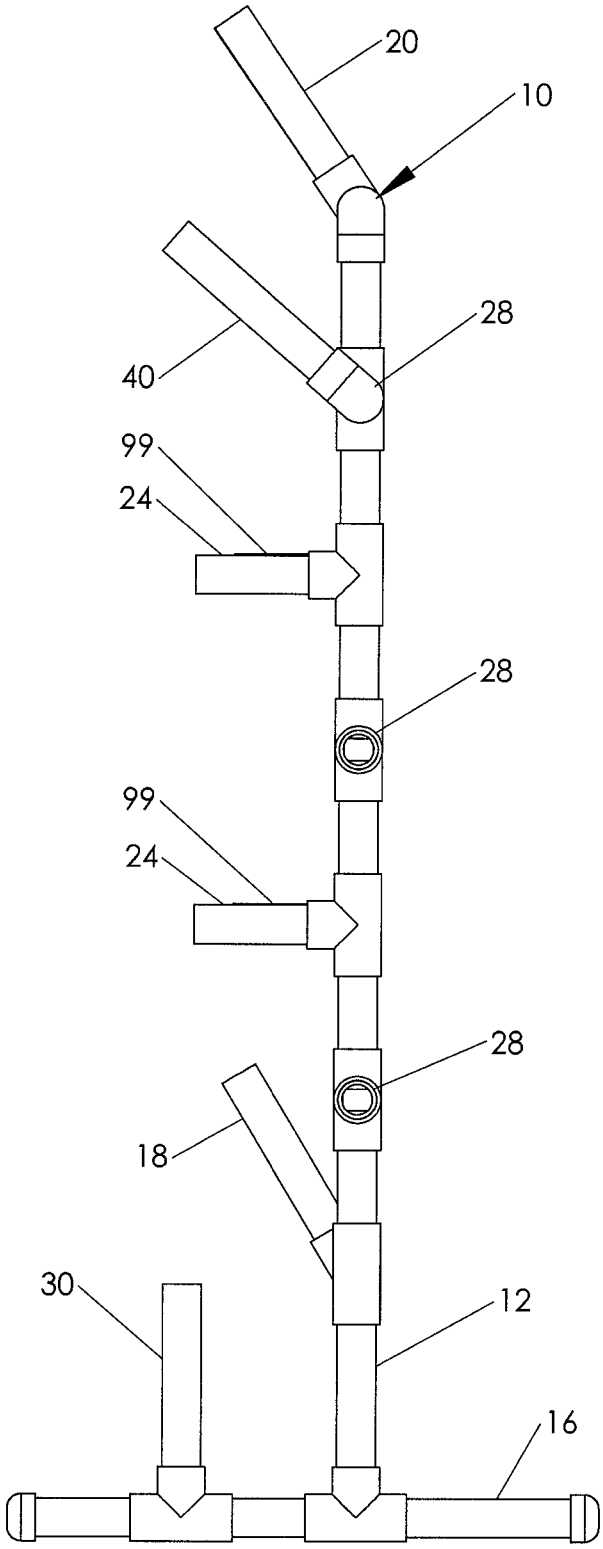
FIG. 2 is a side elevation view of the first exemplary embodiment of the therapy device.

FIG. 1 is a perspective view of a first exemplary embodiment of a therapy device 10 usable for physical and/or occupation therapy having a pair of spaced apart vertical structural members 11, 12 joined to one another by a pair of spaced apart horizontal structural members 13, 14. As used herein the term "exemplary" is understood to have its common meaning of "being or serving as an illustration of a device". FIG. 2 is a side elevation view of the first exemplary embodiment of the therapy device 10. The therapy device of this first exemplary embodiment was manufactured as a prototype using widely available polyvinyl chloride (PVC) piping components including lengths of straight pipe 90, T-joints 91, ninety degree elbows 92, and end caps 93 to fabricate the vertical and horizontal structural members and a base 16.

Figure 8:
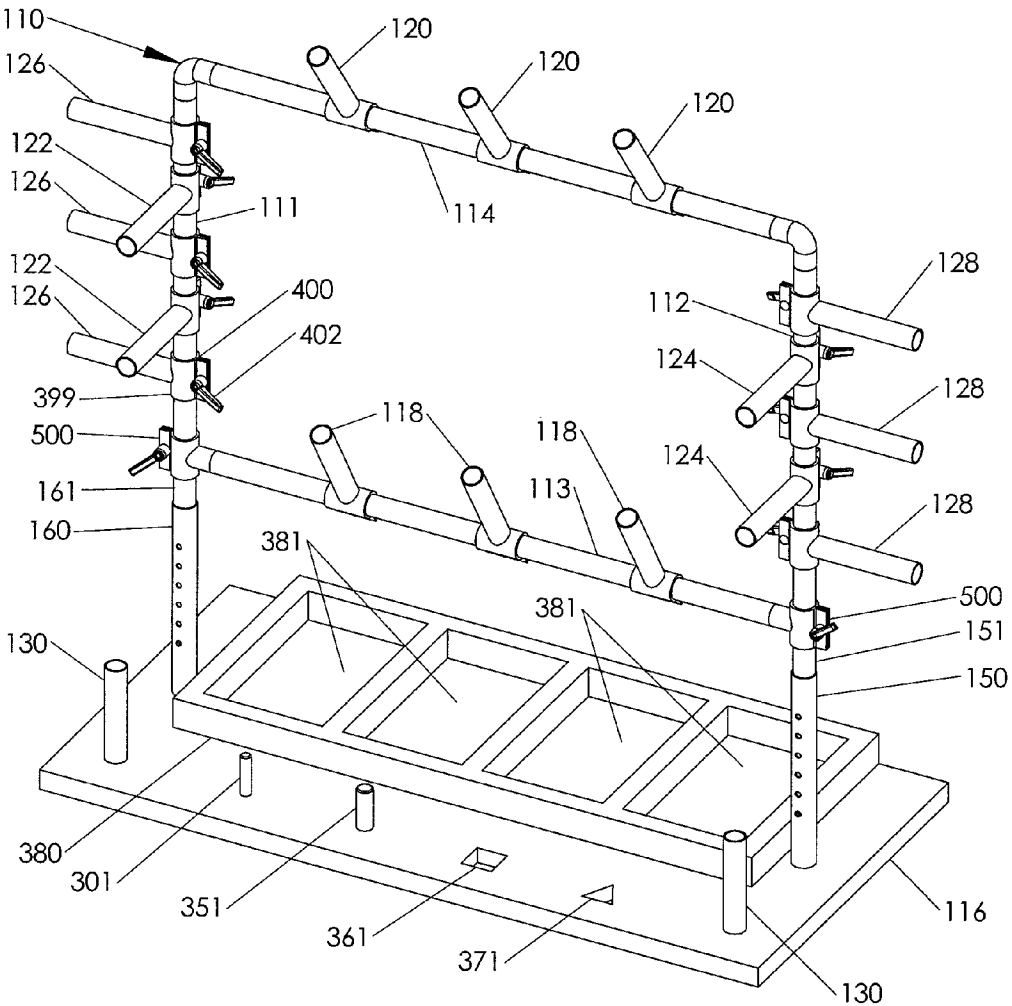
FIG. 8 is a perspective view of a second exemplary embodiment of a therapy device of the present invention.
Figure 12:
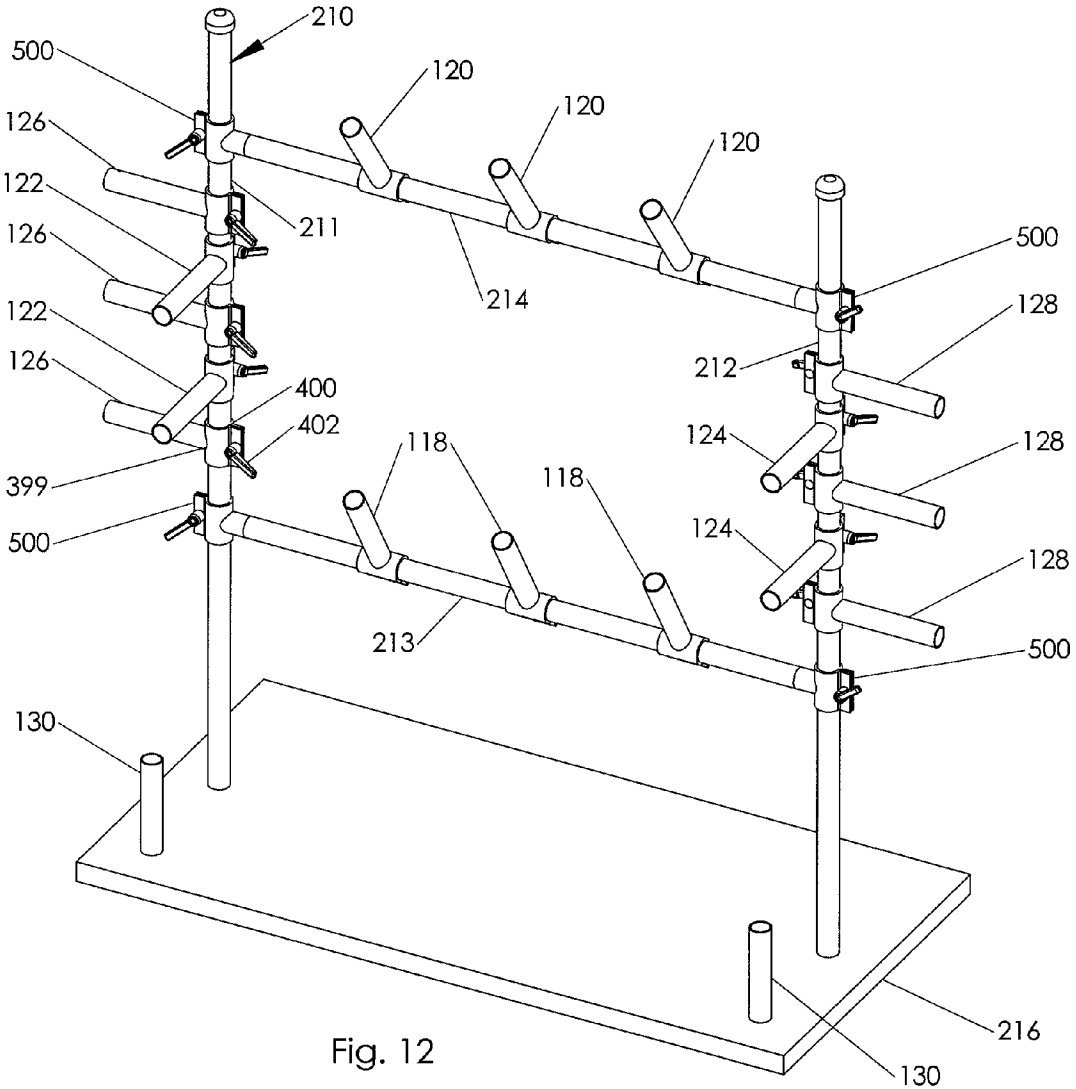
FIG. 12 is a perspective view of a third exemplary embodiment of a therapy device of the present invention.

FIG. 8 is a perspective view of a second exemplary embodiment of a therapy device 110 of the present invention having a pair of spaced apart vertical structural members 111, 112 joined to one another by a pair of spaced apart horizontal structural members 113, 114. FIG. 12 is a perspective view of a third exemplary embodiment of a therapy device 210 of the present invention having a pair of spaced apart vertical structural members 211, 212 joined to one another by a pair of spaced apart horizontal structural members 213, 214. It is understood that all components of a therapy device of the present invention may comprise any suitable material including but not limited to a metal or a polymer. The structural members may be hollow or solid tubes of circular or rectangular cross section, or any other suitable configuration. With reference to FIGS. 1, 2, 8 and 12 a base 16, 116, 216 may be provided for securing the vertical structural members 11, 12; 111, 112; 211, 212 in a vertical orientation. It is understood that the base may be a single base member in the form of a plate 116, 216 with a base member attached to a lower end of each of the vertical structural members 111, 112; 211, 212, as shown in FIGS. 8 and 12, or a pair of base members 16 with a base member attached to a lower end of each of the vertical structural members 11, 12 as shown in FIG. 1.

Figure 4:
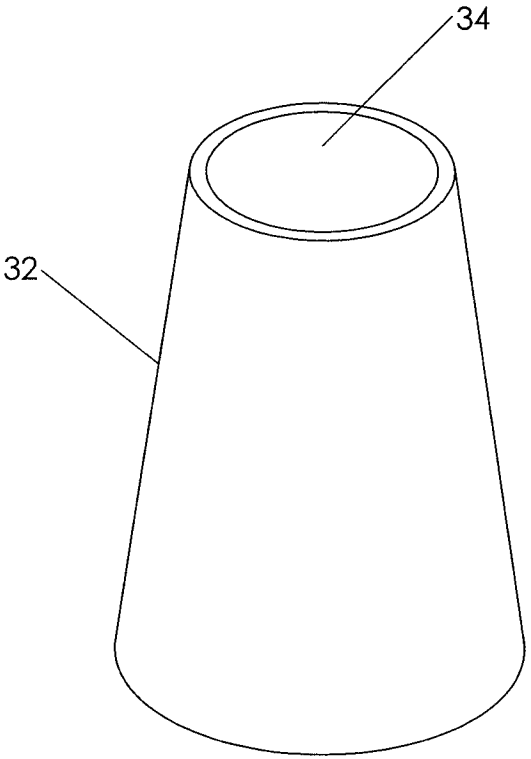
FIG. 4 shows a tool that a physical therapy patient uses by placing the tool on a target of the therapy device.

In each of the illustrated exemplary embodiments 10, 110, 210 each of the vertical and horizontal structural members has at least one target, and preferably a plurality of targets, 18, 20, 22, 24, 26, 28; 118, 120, 122, 124, 126, 128 fixed to and protruding from the structural member. Inasmuch as the targets of the second and third exemplary embodiments are the same in structure, the targets in FIGS. 8 and 12 have the same reference numbers. As used herein and in the claims the term "target" is understood to have the common meaning of something that is aimed at to perform a job or achieve a goal. Preferably the base member 16; 116, 216 is provided with at least one vertical target 30; 130 that may also be used for storing one or more tools 32, an example of which is shown in FIG. 4 The tool 32 has an interior passage 34 of a size that can receive a target 18, 20, 22, 24, 26, 28, 30; 118, 120, 122, 124, 126, 128, 130 whereby a therapy patient can grasp the tool and place the tool on a target designated by a therapist such that the target is located in the interior passage of the tool. As shown an exterior surface of the tool 32 is conical and the interior passage is tapered with the tool being truncated, that is to say the end or point of the cone is cut off so that the interior passage extends the entire length of the tool with the tool having openings at both ends. As used herein and in the claims the term "tool" is understood to have the common meaning of something that is used in order to perform a job or to achieve a goal. The conical shape of the tool is advantageous because it conforms to the grip of a patient's hand.

Figure 3:
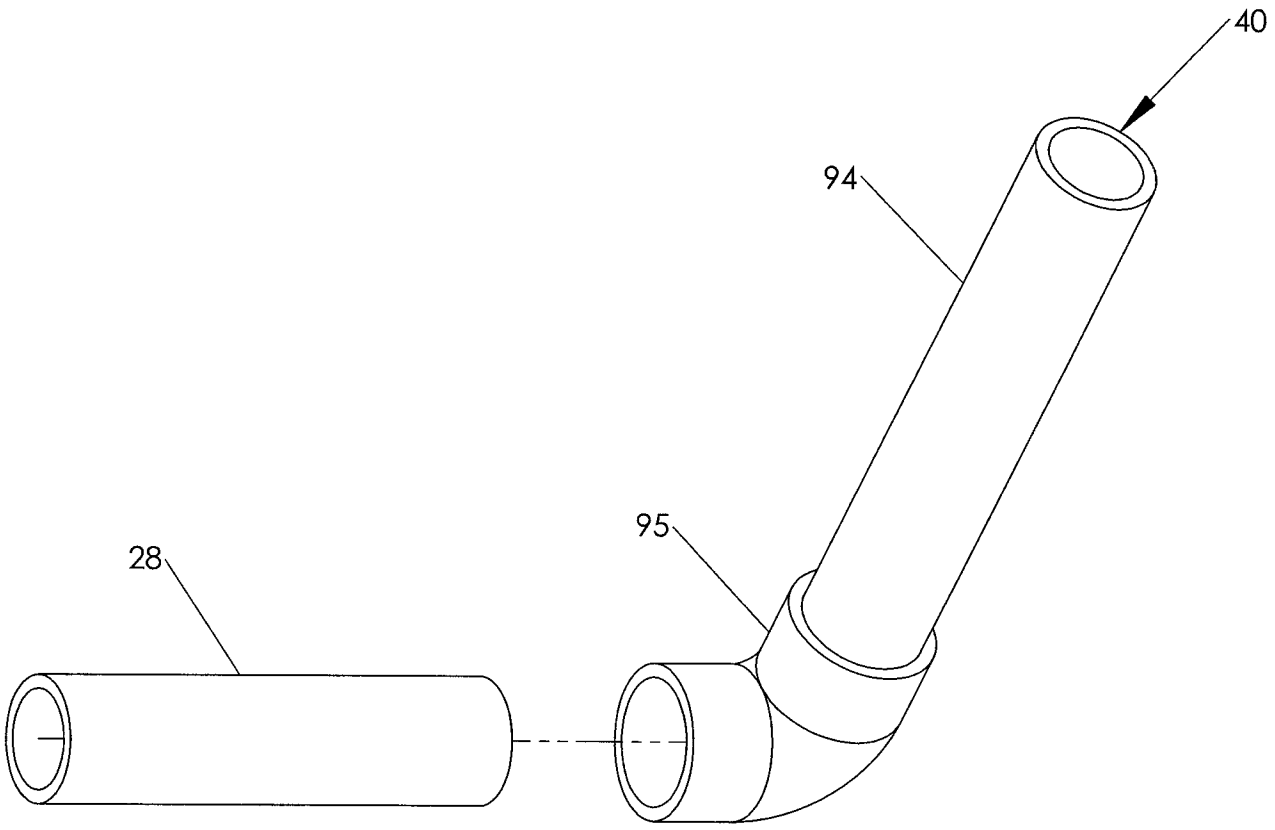
FIG. 3 shows an extension that is attachable to a target of the therapy device.
Figure 5:
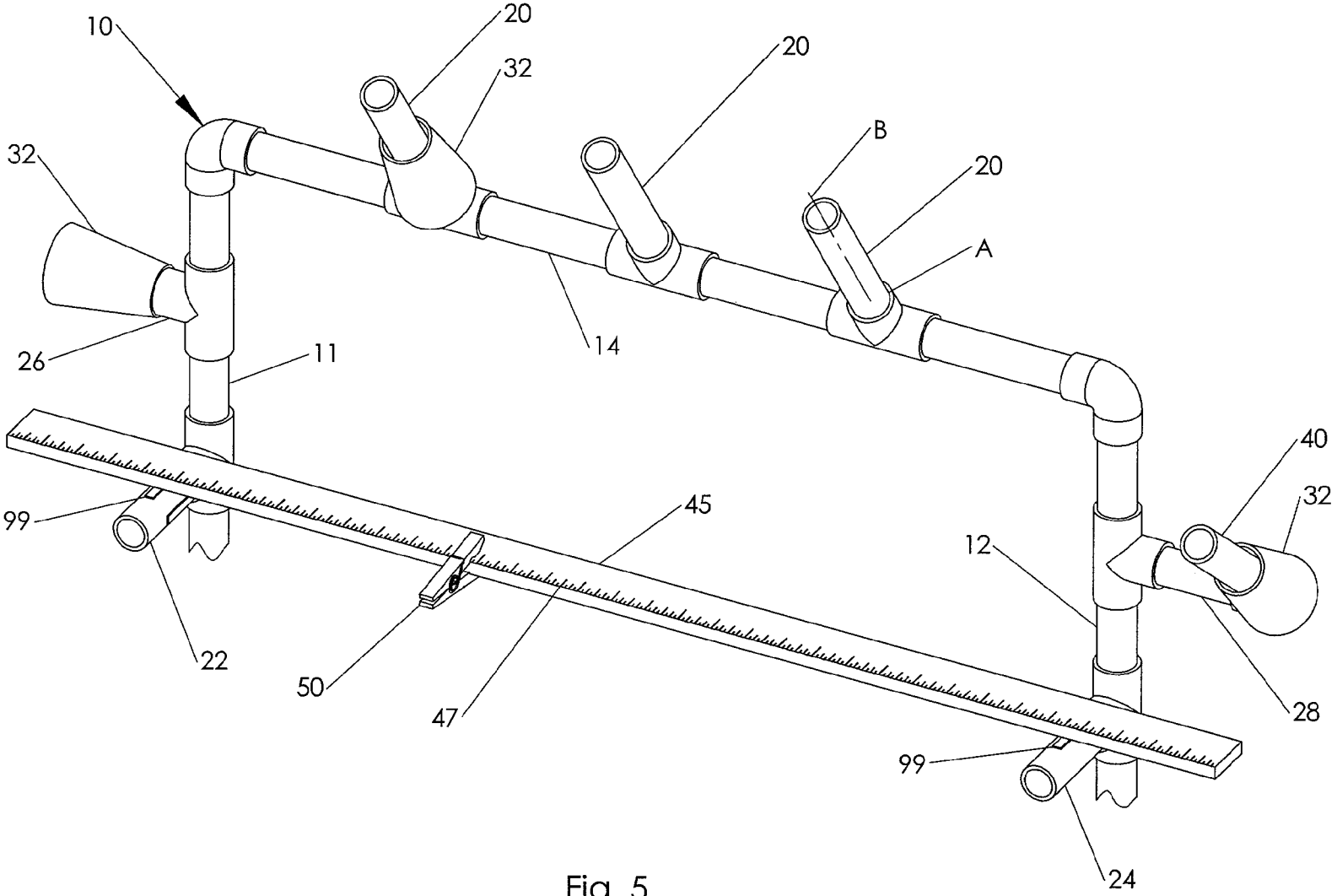
FIG. 5 is a fragmentary perspective view of the therapy device with a bar fixed in place on the device with the bar oriented horizontally.

With reference to FIG. 5 each of the targets is a shown as cylindrical member each having a first end A fixed to a structural member of the device and having an axis B that is oriented such that a tool 32 placed on the target will remain on the target without the use of a means for securing the tool to the target. That is to say the axis B of each target should be oriented in a range from horizontal to extending vertically upward. As used herein and in the claims the term "cylindrical" is understood to have the common meaning of having the form of a cylinder or tube. It is advantageous to attach at least some of the targets to the structural members such that the orientation of the axis B of a target with respect to a structural member is variable to allow the physical therapist to provide a greater range of exercises. For example, the upper and lower horizontal structural members 13, 14; 113, 114213, 214 may be fitted to the associated T-joints 91, ninety degree elbows 92, or collar arrangements 500 such that the horizontal structural members and the targets fixed thereto may be rotated to vary the orientation of the targets. Other means for varying the locations and orientations of targets are described below. It is understood that variations in the disposition of the targets will be indicative of the status of a therapy patient. With reference to FIG. 3 the therapy device may further comprise an angular target extension 40 that attaches to a target, in this example a target 26 protruding from one of the vertical structure members 12, to allow the therapy patient to exercise a joint and the associated tissues in a manner different from when the tool is placed on a target that is not provided with the angular target extension. As shown the angular extension comprises a straight piece 94 of PVC piping, of substantially the same dimensions as the targets fixed to the vertical and horizontal structural members, assembled with a ninety degree elbow 95 having dimensions that are complementary to the targets fixed to the vertical and horizontal structural members. It is understood that an angular target extension may be made as a single piece.

Figure 10:
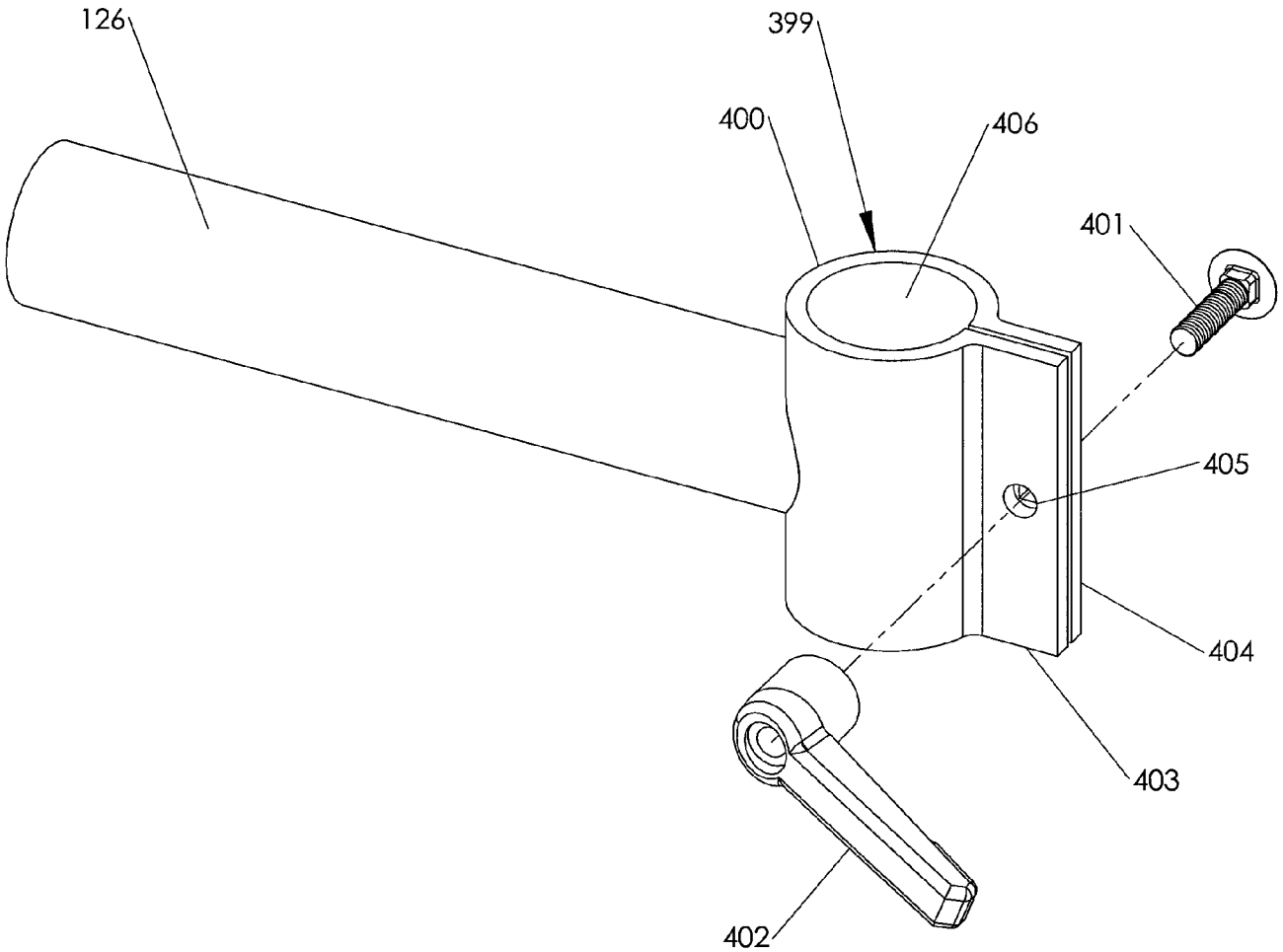
FIG. 10 is an exploded view of an adjustable target for attachment to a structural member of the therapy device.

FIG. 10 is an exploded view of a component 399 for incorporation in a therapy device of the present invention that facilitates varying the orientations presented to a patient of targets attached to the horizontal and vertical structural members of the therapy device. The second and third exemplary therapy device 110 of FIG. 8 has each of the targets 118, 120, 122, 124, 126, 128 made adjustable with a component of the structure shown in FIG. 10. For example as shown in FIG. 10 a cylindrical target 126 is fixed to a collar 400 having a passage 406 that receives a structural member 111, 112, 113, 114 of the therapy device. The collar 400 has a pair of mating flanges 403, 404 having aligned holes 405 that receive a threaded bolt 401. On end of a lever 402 is provided with interior threads that are complementary to and mate with the threads of the threaded bolt 401. When the lever 402 is rotated to loosen the collar on a structural member the target may be swiveled with respect to the structural member to an orientation selected by a therapist, and thereafter the lever is rotated to tighten the collar on the structural member and retain the target in the orientation selected by the therapist. After a patient is done placing tools on the targets as a therapeutic exercise the orientation of the targets can be readily adjusted to meet the needs of the next patient. It is understood that any other suitable means for adjusting the orientation of the targets of a therapy device may be employed without deviating from the scope of the present invention.

Figure 9:
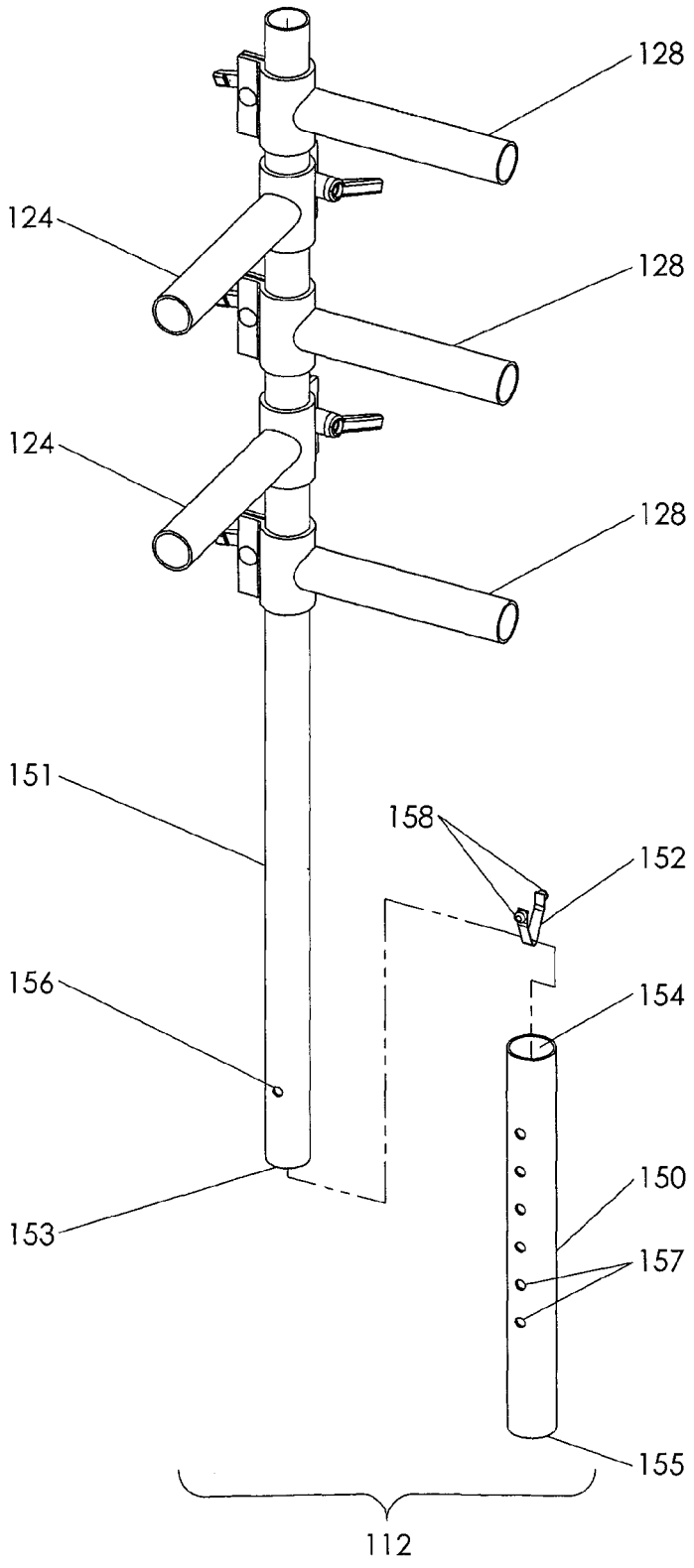
FIG. 9 is an exploded view of one of the vertical structural members the therapy device of the second exemplary embodiment.

A therapy device of the present invention may be sized to rest on a table top or as a floor model that rests on a floor. In either case it is preferred that the height of at least one of the horizontal structural members be adjustable. That is to say it is preferable that the vertical distance between the base 16, 116, 216 and at least one of the horizontal structural members 13, 14; 113, 114, 213, 214 is adjustable to accommodate the size and status of a therapy patient. The height of the targets fixed to the structural members during therapy is an indication of the status and progress of a therapy patient and can indicate improvement of the patient when the patient can place a tool on a target of increased height as the therapy device is adjusted during a regimen of treatment. Referring to FIGS. 8 and 9 there is presented an example of a means for adjusting the height of the vertical structural members of a therapy device to cause an adjustment in the height of at least one of the horizontal structural members. FIG. 9 is an exploded view of a vertical structural member 112 of the therapy device 110 of the second exemplary embodiment. An extendable vertical structural member 112 has two hollow telescoping sections 150, 151. A lower section 150 has an inside diameter that is slightly larger than the outside diameter of an upper section 151 which allows the upper section to be inserted into the lumen 154 of the lower section. The upper section 151 has targets 124, 128 protruding from it as described above. A spring loaded locking device 152 is placed into the interior of the upper section through a first end 153 of the upper section with buttons 158 of the locking device protruding through diametrically opposed holes 156 in the upper section. The lower section is provided with a series of pairs of diametrically opposed holes 157 with longitudinally next adjacent holes spaced about one to two inches (two and a half to five centimeters) apart. The upper section 151 is inserted into the lower section 150 with the diametrically opposed holes 156 in the upper section aligned with a pair of the diametrically opposed holes 157 in the lower section whereby the buttons of the locking device extend through the aligned holes in the sections to maintain a selected height of the vertical structural member. To adjust the height of the vertical structural member the buttons 158 of the locking device 152 are depressed through the holes 157 in the lower section 150. Next the upper section 151 is either pulled upwards or pushed downwards until the buttons 158 of the locking device 152 extend through a second set of diametrically opposed holes 157 in the lower section at a desired height that are aligned with the diametrically opposed holes 156 in the upper section whereby the buttons of the locking device extend through the aligned holes in the sections to maintain the newly selected height of the vertical structural member. It is understood that any other suitable means for adjusting the height of the vertical structural members of a therapy device may be employed without deviating from the scope of the present invention.

The lower vertical structural member 113 in FIG. 8 is equipped at each end with a similar collar arrangement 500 to facilitate adjusting the height of this horizontal structural member independent of the height of the vertical structural members 111, 112. Referring next to the therapy device of the third exemplary embodiment 210 of FIG. 12 the vertical structural members 211, 212 have a fixed height and both the lower and upper horizontal structural members 213, 214 are equipped at each end with a collar arrangement 500 to that has already been described and shown in FIG. 10 to facilitate adjusting the height of at least one of the horizontal structural members independent of the height of the vertical structural members 211, 212. In the embodiments 110, 210 of FIGS. 8 and 12 at least one of the horizontal structural members is joined to the vertical structural members in a manner that allows the horizontal structural member to be moved along the vertical structural members to adjust the height of the horizontal structural member. After a patient is done placing tools on the targets as a therapeutic exercise the heights of the horizontal structural members and the associated targets can be readily adjusted to meet the needs of the next patient.

The hollow truncated conical tool 32 presented in FIG. 4 may be placed on any of the targets 18, 20, 22, 24, 26, 28, 30; 118, 120, 122, 124, 126, 128, 130 with either the smaller or larger diameter end of the tool placed first on the target, as directed by the therapist. Referring to FIG. 5 which shows a fragmentary perspective view of an upper portion of a therapy device 10 of the present invention a tool 32 has been placed smaller end first on a target 26 extending from a vertical support member 11, another tool 32 has been placed larger end first on a target 20 extending from the uppermost horizontal support member 14, and yet another tool 32 has been placed larger end first on a target extension 40 fixed to a target 28 extending from the other vertical support member 12. The patient may perform exercises or tasks employing forward flexion by reaching straight out and elevating his arms when placing tools on the targets 18, 20; 118, 120 associated with the lower and upper horizontal structural members 13, 14; 113, 114. The patient may perform exercises or tasks employing scaption, that is to say abduction in the scapular plane of the shoulder by reaching across his body to place tools on targets designated by the therapist. The patient may perform exercises or tasks employing both supination, that is to say palm up, and pronation, that is to say palm down, on targets designated by the therapist by alternatively placing the smaller diameter end of the tool on the target and then the larger diameter end of the tool on the same target. This latter exercise or task involves turning the wrist in opposite directions with radial and ulnar deviation. A therapist working with a patient using the therapy device of the present invention can advantageously make an objective evaluation of the status and improvement of a patient because the height and orientation of the targets can be readily measured and recorded. The data obtained can be provided to a physician managing a patient's treatment and the patient's health insurance company as required.

Figure 7:
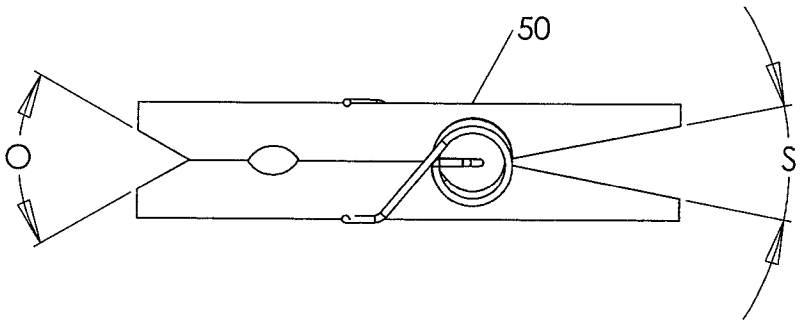
FIG. 7 shows a spring loaded clothespin that a physical therapy patient uses by pinching the clothespin and attaching it to the bar with the bar oriented either horizontally or vertically.
Figure 6:
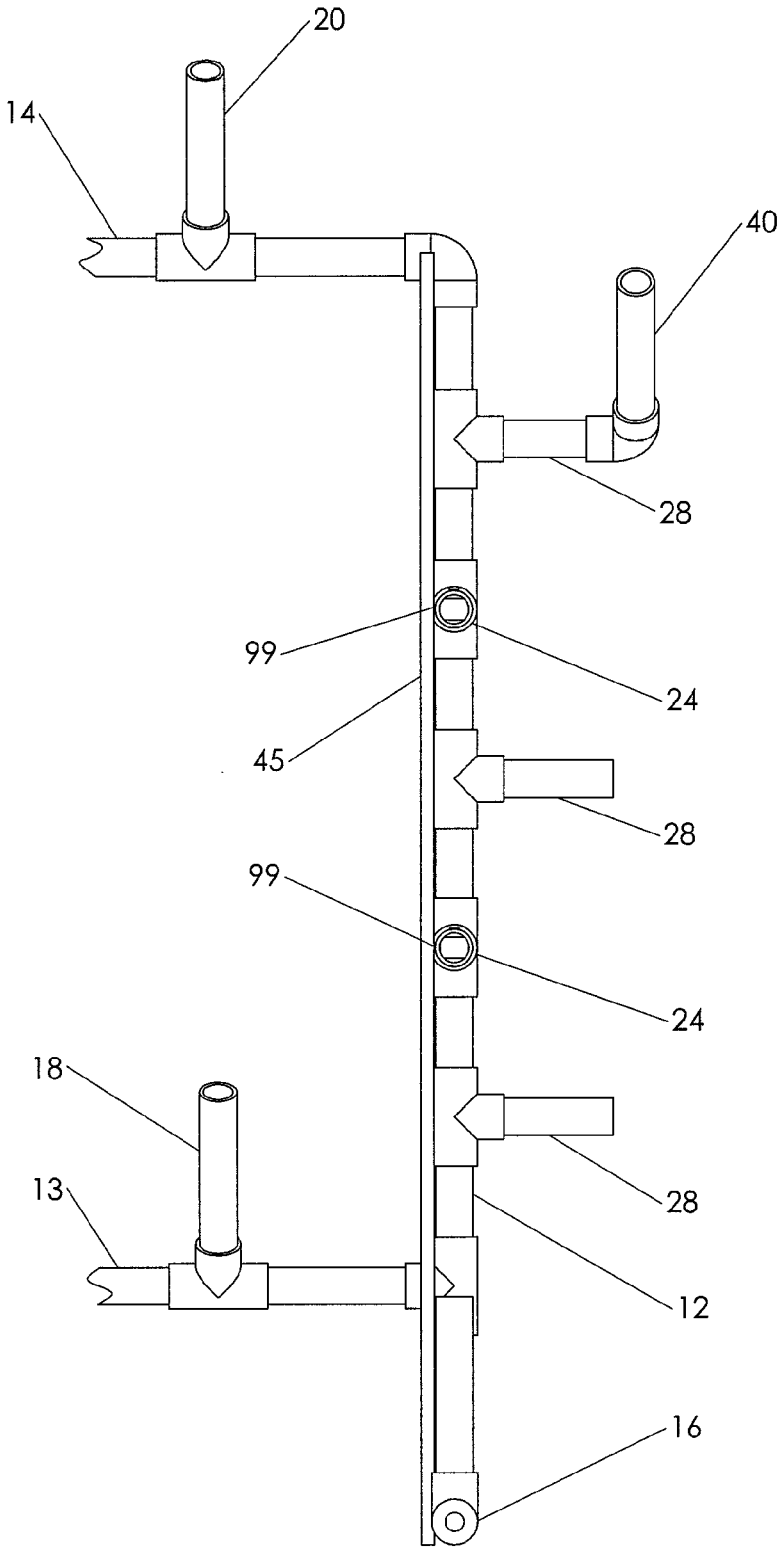
FIG. 6 is a fragmentary perspective view of the therapy device with a bar fixed in place on the device with the bar oriented vertically.

Still referring next to FIG. 5 a bar 45 is fixed in place to the horizontally extending targets 22, 24 of the two vertical structural members 11, 12 with the bar oriented horizontally. For this purpose at least one target 22, 24 associated with each of the vertical structural members 11, 12 is oriented to be extend horizontally with the horizontally extending targets 22, 24 on each of the vertical structural members 11, 12 located at the same height and extending parallel to one another. In FIG. 5 the bar 45 is fixed in place by a means for fixing the bar in place, such as a hook and loop system 99, against the horizontally extending targets 22, 24 of the two vertical structural members 11, 12 with the bar oriented horizontally. Alternatively as shown in FIG. 6 the bar 45 is fixed in place by a means for fixing the bar in place, such as a hook and loop system 99, against two targets 24 extending horizontally from one of the vertical structural members 12 with the bar oriented vertically. An exercise may be conducted using a tool that is a spring loaded clothespin 50 shown in FIG. 7 that a physical therapy patient can grip and pinch as shown at arrow S causing the jaws of the clothespin to move apart as shown at arrow O such that the clothespin can be attached to the bar 45 as shown in FIG. 5. Clothespins of various sizes provided with springs of various strengths should be provided to accommodate the status of the patient. The bar 45 may be provided with distance indicating marks 47. It is understood that the bar 45 may be mounted to either the higher or lower targets 24, 26 as desired by the therapist. A therapist working with a patient using the therapy device of the present invention can advantageously make an objective evaluation of the status and improvement of a patient because the size of the clothespins used by a patient and the placement of the clothespins can be readily measured and recorded. The data obtained can be provided to a physician managing a patient's treatment and the patient's health insurance company as required.

Figure 11A:
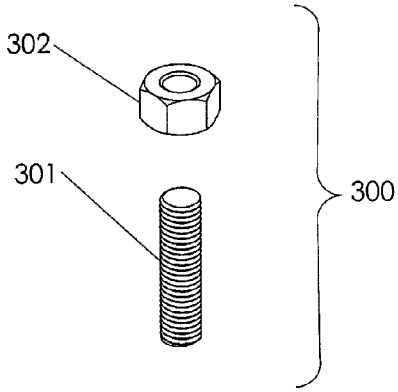
FIGS. 11A to 11 D show schematic representations of targets and tools used with the therapy device to exercise and evaluate fine motor skills.
Figure 11B:
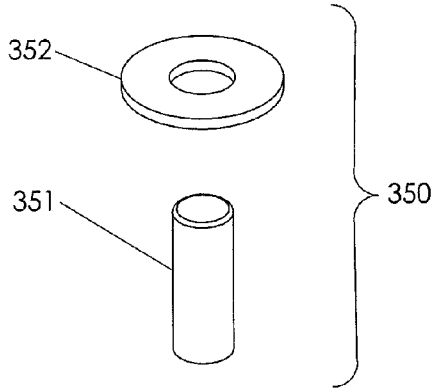
Figure 11C:
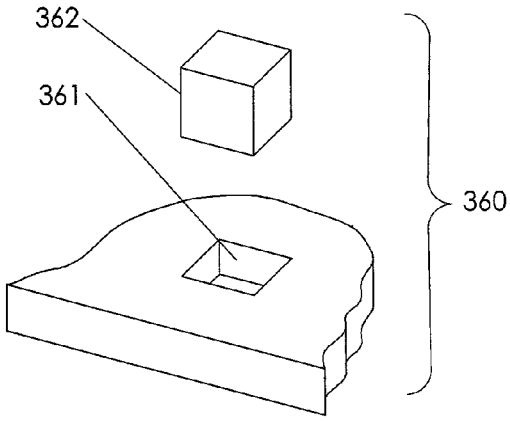
Figure 11D:
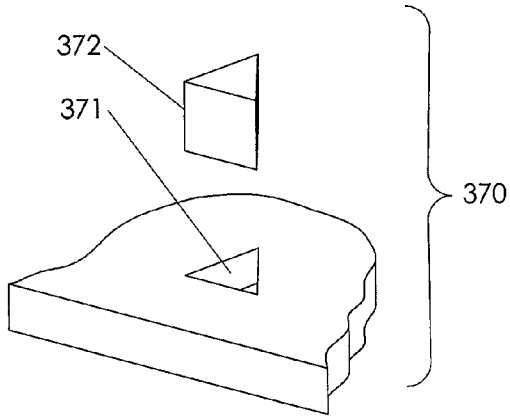

Referring to FIGS. 8 and 11A to 11D the therapy device may further include a component for exercising and evaluating fine motor skills of a therapy patient. A container 380 with multiple compartments 381 contains a variety of tools 302, 352, 362, 372 that may be mated with complementary targets 301, 351, 361 and 371. As shown in FIG. 11A a first example of a component 300 for exercising and evaluating a fine motor skill of a therapy patient comprises a threaded stud 301 upon which the patient places a threaded nut 302 that he removes from a compartment 381 of the container 380. As shown in FIG. 11B a second example of a component 350 for exercising and evaluating a fine motor skill of a therapy patient comprises an unthreaded stud 351 upon which the patient places a washer or ring 352 that he removes from a compartment 381 of the container 380. As shown in FIG. 11C a third example of a component 360 for exercising and evaluating a fine motor skill of a therapy patient comprises a square hole 361 into which the patient places a square peg 362 that he removes from a compartment 381 of the container 380. As shown in FIG. 11D a fourth example of a component 370 for exercising and evaluating a fine motor skill of a therapy patient comprises a triangular shaped hole 371 into which the patient places a triangular shaped peg 372 that he removes from a compartment 381 of the container 380. It is understood that the targets and tools provided as components of the therapy device for exercising and evaluating a fine motor skill of a therapy patient may be of any desirable form in accordance with the skill being evaluated and exercised.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall there between.

What is claimed is:

1. A therapy device comprising a pair of spaced apart vertical structural members joined to one another by a pair of spaced apart horizontal structural members, each of the vertical and horizontal structural members having at least one target protruding from the structural member; and at least one tool having an interior passage of a size that can receive a target whereby a physical therapy patient can grasp the tool and place the tool on a target designated by a therapist such that the target is located in the interior passage of the tool.

2. The therapy device of claim 1 further comprising at least one base member for securing the vertical structural members in a vertical orientation.

3. The therapy device of claim 1 wherein a height of at least one of the horizontal structural members is adjustable.

4. The therapy device of claim 3 wherein the height of the horizontal structural members is an indication of the status of the physical therapy patient.

5. The therapy device of claim 1 wherein the targets are cylindrical members having a first end fixed to a structural member of the device and have an axis that is oriented such that a tool placed on the target will remain on the target without the use of a means for securing the tool to the target.

6. The therapy device of claim 1 wherein an exterior surface of the tool is conical and the interior passage is tapered.

7. The therapy device of claim 5 wherein an exterior surface of the tool is conical and the interior passage is tapered.

8. The therapy device of claim 1 wherein the orientation of the axis of a target with respect to an associated structural member is variable.

9. The therapy device of claim 3 wherein the orientation of the axis of a target with respect to an associated structural member is variable.

10. The therapy device of claim 1 further comprising an angular target extension that is attachable to a target to allow the physical therapy patient to exercise a joint in a manner different from when the tool is place on a target that is not provided with the angular extension.

11. The therapy device of claim 8 further comprising an angular extension that is attachable to a target to allow the physical therapy patient to exercise a joint in a manner different from when the tool is place on a target that is not provided with the angular extension.

12. The therapy device of claim 9 further comprising an angular extension that is attachable to a target to allow the physical therapy patient to exercise a joint in a manner different from when the tool is place on a target that is not provided with the angular extension.

13. The therapy device of claim 1 wherein each of the vertical structural members is provided with a pair of horizontally extending targets located spaced apart from one another, the horizontally extending targets on each of the vertical structural members being located at the same height and the horizontally extending targets on the two vertical structural members being parallel to one another, the therapy device further comprising a bar and a means for fixing the bar in place with the horizontally extending targets of the two vertical structural members with the bar oriented horizontally, and at least one spring loaded clothespin that a physical therapy patient can pinch and attach to the bar.

14. The therapy device of claim 1 wherein one of the vertical structural members is provided with a pair of horizontally extending targets located spaced apart from one another and parallel to one another, the therapy device 14 further comprising a bar and a means for fixing the bar in place against the horizontally extending targets of associated with the vertical structural member with the bar oriented vertically, and at least one spring loaded clothespin that a physical therapy patient can pinch and attach to the bar.

15. The therapy device of claim 1 further comprising a component for exercising and evaluating a fine motor skill of a therapy patient.

16. A therapy device comprising a pair of spaced apart vertical structural members joined to one another by a pair of spaced apart horizontal structural members, at least one of the horizontal structural members having a height that is adjustable, each of the vertical and horizontal structural members having at least one target protruding from the structural member wherein the orientation of the axis of a target with respect to an associated structural member is variable; and at least one tool having an interior passage of a size that can receive a target whereby a physical therapy patient can grasp the tool and place the tool on a target designated by a therapist such that the target is located in the interior passage of the tool.

17. The therapy device of claim 16 wherein the vertical structural members have a height that is adjustable to adjust the height of at least one of the horizontal structural members joined to the vertical structural members.

18. The therapy device of claim 16 wherein at least one of the horizontal structural members is joined to the vertical structural members in a manner that allows the horizontal structural member to be moved along the vertical structural members to adjust the height of the horizontal structural member.

19. The therapy device of claim 16 wherein each of the vertical structural members is provided with a pair of horizontally extending targets located spaced apart from one another, the horizontally extending targets on each of the vertical structural members being located at the same height and the horizontally extending targets on the two vertical structural members being parallel to one another, and further comprising a bar and a means for fixing the bar in place either against the horizontally extending targets of the two vertical structural members with the bar oriented horizontally, or against the horizontally extending targets of only one of the vertical structural members with the bar oriented vertically, and at least one spring loaded clothespin that a physical therapy patient can pinch and attach to the bar.

20. The therapy device of claim 16 further comprising a component for exercising and evaluating a fine motor skill of a therapy patient.

* * * * *